US012066221B2

(12) United States Patent
Silva et al.

(10) Patent No.: US 12,066,221 B2
(45) Date of Patent: Aug. 20, 2024

(54) MODULAR WATERSIDE ECONOMIZER INTEGRATED WITH AIR-COOLED CHILLERS

(71) Applicant: Carrier Corporation, Palm Beach Gardens, FL (US)

(72) Inventors: Frank Silva, Huntersville, NC (US); Biswajit Mitra, Huntersville, NC (US); Richard G. Lord, Murfreesboro, TN (US)

(73) Assignee: Carrier Corporation, Palm Beach Gardens, FL (US)

( * ) Notice: Subject to any disclaimer, the term of this patent is extended or adjusted under 35 U.S.C. 154(b) by 276 days.

(21) Appl. No.: 17/254,196

(22) PCT Filed: May 12, 2020

(86) PCT No.: PCT/US2020/032440

§ 371 (c)(1),
(2) Date: Dec. 18, 2020

(87) PCT Pub. No.: WO2020/247154

PCT Pub. Date: Dec. 10, 2020

(65) Prior Publication Data

US 2021/0262705 A1 Aug. 26, 2021

Related U.S. Application Data

(60) Provisional application No. 62/858,574, filed on Jun. 7, 2019.

(51) Int. Cl.
*F25B 13/00* (2006.01)
*F25B 41/20* (2021.01)

(52) U.S. Cl.
CPC ..... *F25B 13/00* (2013.01); *F25B 41/20* (2021.01); *F25B 2400/13* (2013.01)

(58) Field of Classification Search
CPC ..... F25B 13/00; F25B 41/20; F25B 2400/13
See application file for complete search history.

(56) References Cited

U.S. PATENT DOCUMENTS 5,924,088 A 7/1999 Shaw
7,114,349 B2 10/2006 Lifson et al.
(Continued)

FOREIGN PATENT DOCUMENTS

CN 106766332 12/2016
DE 102015221346 5/2017
(Continued)

OTHER PUBLICATIONS

Emerson Network Power. Energy Efficient Cooling Solutions for Data Centers: Introducing an Emerson Network Power tool for evaluating cooling system total cost of ownership. Nov. 2007. pg. 3.
(Continued)

*Primary Examiner* — Miguel A Diaz
(74) *Attorney, Agent, or Firm* — Carlson, Gaskey & Olds, P.C.

(57) ABSTRACT

A hydronic economizer module is configured for use in a chiller system that has a vapor compression cycle. The hydronic economizer module includes a heat exchanger assembly located within a housing having at least one heat exchanger coil, a fan assembly having at least one fan generally aligned with at least one heat exchanger coil, and at least one valve is movable between a plurality of positions to control a flow of fluid into the heat exchanger assembly. When the at least one valve is in a first position, the economizer module is arranged in parallel with a flat plate heat exchanger. When the at least one valve is in a second position, the economizer module is arranged in series with the flat plate heat exchanger. The flat plate heat exchanger
(Continued)

includes at least one fluid port for communicating with a component of the vapor compression cycle.

17 Claims, 6 Drawing Sheets

(56) References Cited

U.S. PATENT DOCUMENTS

| | | | | |
|---|---|---|---|---|
| 9,103,571 | B2 | 8/2015 | Yang et al. | |
| 9,278,303 | B1 | 3/2016 | Somani et al. | |
| 9,476,657 | B1 * | 10/2016 | Pettis | G05D 23/1932 |
| 9,587,867 | B2 | 3/2017 | Lee et al. | |
| 9,797,640 | B2 | 10/2017 | Umeda et al. | |
| 9,869,487 | B2 | 1/2018 | Nickey et al. | |
| 10,119,717 | B2 * | 11/2018 | Matsuo | F28F 27/00 |
| 10,215,470 | B2 * | 2/2019 | Nikaido | F25D 21/006 |
| 2008/0053114 | A1 | 3/2008 | Zhao | |
| 2009/0126399 | A1 * | 5/2009 | Takegami | F25B 47/022 62/510 |
| 2010/0242532 | A1 * | 9/2010 | Kopko | F25B 41/00 62/513 |
| 2011/0192188 | A1 * | 8/2011 | Nickey | F28B 1/06 165/104.34 |
| 2014/0096547 | A1 * | 4/2014 | Boehde | F24F 1/50 62/181 |
| 2014/0202177 | A1 * | 7/2014 | Rush | F24F 3/06 62/335 |
| 2014/0338391 | A1 * | 11/2014 | Keisling | F25B 39/02 62/513 |
| 2015/0354849 | A1 * | 12/2015 | Matsuo | F25B 25/005 62/181 |
| 2016/0209087 | A1 * | 7/2016 | Reytblat | F28C 1/08 |
| 2016/0305702 | A1 * | 10/2016 | Nikaido | F25D 21/006 |
| 2017/0227263 | A1 | 8/2017 | Kopko | |
| 2017/0234559 | A1 | 8/2017 | Federspiel et al. | |
| 2017/0268792 | A1 * | 9/2017 | Costakis | F25B 23/006 |
| 2018/0224149 | A1 | 8/2018 | Lazzari | |
| 2019/0301819 | A1 * | 10/2019 | Nagata | F28F 19/01 |
| 2020/0200445 | A1 * | 6/2020 | Rajendran | F25B 5/02 |
| 2020/0284480 | A1 * | 9/2020 | Tolouei Asbforoushani | F25B 25/005 |
| 2020/0309433 | A1 * | 10/2020 | Wang | F25B 49/02 |
| 2021/0088260 | A1 * | 3/2021 | Silva | F28D 5/02 |

FOREIGN PATENT DOCUMENTS

| | | |
|---|---|---|
| EP | 2102569 | 6/2017 |
| EP | 3273169 | 1/2018 |
| WO | 2011019909 A1 | 2/2011 |
| WO | 2017160346 | 9/2017 |
| WO | 2018187570 | 10/2018 |

OTHER PUBLICATIONS

Rogan, M. Arctic Chiller Group. Free Cooling Fundamentals in Modular HVAC Chillers. pg. 5.

Brett, G. Environmental Systems Design, Inc. Digital Realty—Data Center Solutions. Sep. 2012. pp. 4-6.

International Search Report and Written Opinion for International Application No. PCT/US2020/032440 dated Aug. 26, 2020.

International Preliminary Report on Patentability for International Application No. PCT/US2020/032440 dated May 12, 2020.

* cited by examiner

MODULAR WATERSIDE ECONOMIZER INTEGRATED WITH AIR-COOLED CHILLERS

CROSS-REFERENCE TO RELATED APPLICATIONS

This application claims priority to U.S. Provisional Application No. 62/858,574, which was filed on Jun. 7, 2019 and is incorporated herein by reference.

BACKGROUND

Embodiments of this disclosure relate generally to chilled refrigeration systems and, more particularly, to a hydronic free cooling economizer for use with a chilled fluid refrigeration system.

Chilled fluid systems provide a temperature conditioned fluid, for use in conditioning the air within large buildings and other facilities. The chilled fluid is typically pumped to a number of remote heat exchangers or system coils for cooling various rooms or areas within a building. A chilled fluid system enables the centralization of the air conditioning requirements for a large building or complex of buildings by using water or a similar fluid as a safe and inexpensive temperature transport medium.

In general a chilled fluid system is configured to provide chilled fluid at a particular temperature, via a first fluid loop, for cooling and dehumidify air in a building. Heat and moisture are extracted from the building air, and the heat is transferred to the fluid in the first fluid loop, and is returned via the first fluid loop to the chilled fluid system. The returned fluid is again cooled to the desired temperature by transferring the heat of the fluid to the chiller's refrigerant. After the refrigerant is compressed by a compressor, the heat in the refrigerant is transported to the condenser. Some units use a water cooled condenser where heat is transferred to a second fluid, such as water for example. The second fluid loop transports waste heat from the condenser of the chiller to a cooling tower which then transfers the waste heat from the second water loop to ambient air by direct contact and evaporation of some of the water between the ambient air and the second fluid of the second loop. However, other chilled fluid systems transfer the heat directly to the air using fans and condenser coils.

SUMMARY

In one exemplary embodiment, a hydronic economizer module is configured for use in a chiller system that has a vapor compression cycle. The hydronic economizer module includes a heat exchanger assembly located within a housing having at least one heat exchanger coil, a fan assembly having at least one fan generally aligned with at least one heat exchanger coil, and at least one valve is movable between a plurality of positions to control a flow of fluid into the heat exchanger assembly. When the at least one valve is in a first position, the economizer module is arranged in parallel with a flat plate heat exchanger. When the at least one valve is in a second position, the economizer module is arranged in series with the flat plate heat exchanger. The flat plate heat exchanger includes at least one fluid port for communicating with a component of the vapor compression cycle.

In a further embodiment of the above, the component of the vapor compression cycle that is in fluid communication with the flat plate heat exchanger is an evaporator.

In a further embodiment of any of the above, the hot plate heat exchanger fluidly separates at least one heat exchanger coil from the vapor compression cycle.

In a further embodiment of any of the above, a circulation pump for circulating the flow of fluid through at least one heat exchanger coil and the flat plate heat exchanger.

In a further embodiment of any of the above, there is an expansion tank for collecting the flow of fluid and at least two isolation valves for isolating the flat plate heat exchanger.

In a further embodiment of any of the above, at least one heat exchanger coil includes at least one first heat exchanger coil and at least one second heat exchanger coil.

In a further embodiment of any of the above, at least one first heat exchanger coil and the at least one second heat exchanger coil are arranged into at least one of a V-shaped configuration or a W-shaped configuration.

In a further embodiment of any of the above, at least one fan is a variable speed fan. The hydronic economizer includes at least one access panel aligned with at least one heat exchanger coil.

In a further embodiment of any of the above, at least one heat exchanger coil is coated in a corrosion resistant material.

In another exemplary embodiment, a chiller system includes a vapor compression cycle including an evaporator and a condenser. A hydronic economizer includes at least one economizer module removably attached to the condenser. At least one economizer module includes a heat exchanger assembly located within a housing which includes at least one heat exchanger coil. A fan assembly includes at least one fan generally aligned with at least one heat exchanger coil.

In a further embodiment of any of the above, at least one economizer module is integral with the condenser.

In a further embodiment of any of the above, at least one heat exchanger coil and the condenser are arranged parallel to each other with respect to cooling air flow. At least one heat exchanger coil includes at least one of a round tube or a flat ported tube made of at least one of copper or aluminum.

In a further embodiment of any of the above, the fan assembly includes at least one variable speed fan.

In a further embodiment of any of the above, a controller is in electrical communication with the vapor compression cycle and the hydronic economizer.

In a further embodiment of any of the above, at least one first heat exchanger coil includes a plurality of heat exchanger coils arranged into at least one of a V-shaped configuration or a W-shaped configuration.

In a further embodiment of any of the above, at least one economizer module includes at least one access panel.

In a further embodiment of any of the above, at least one access panel is aligned with at least one heat exchanger coil.

In a further embodiment of any of the above, the hydronic economizer includes at least one valve movable between a plurality of positions to control a flow of fluid into the heat exchanger assembly. When at least one valve is in a first position, the economizer module is arranged in parallel with a component of the vapor compression cycle. When at least one valve is in a second position, the economizer module is arranged in series with the component of the vapor compression cycle.

In a further embodiment of any of the above, at least one heat exchanger coil is coated in a corrosion resistant material.

In a further embodiment of any of the above, the vapor compression cycle includes a chiller controller. The hydronic economizer includes an economizer controller in electrical communication with the chiller controller.

DETAILED DESCRIPTION

Figure 1:
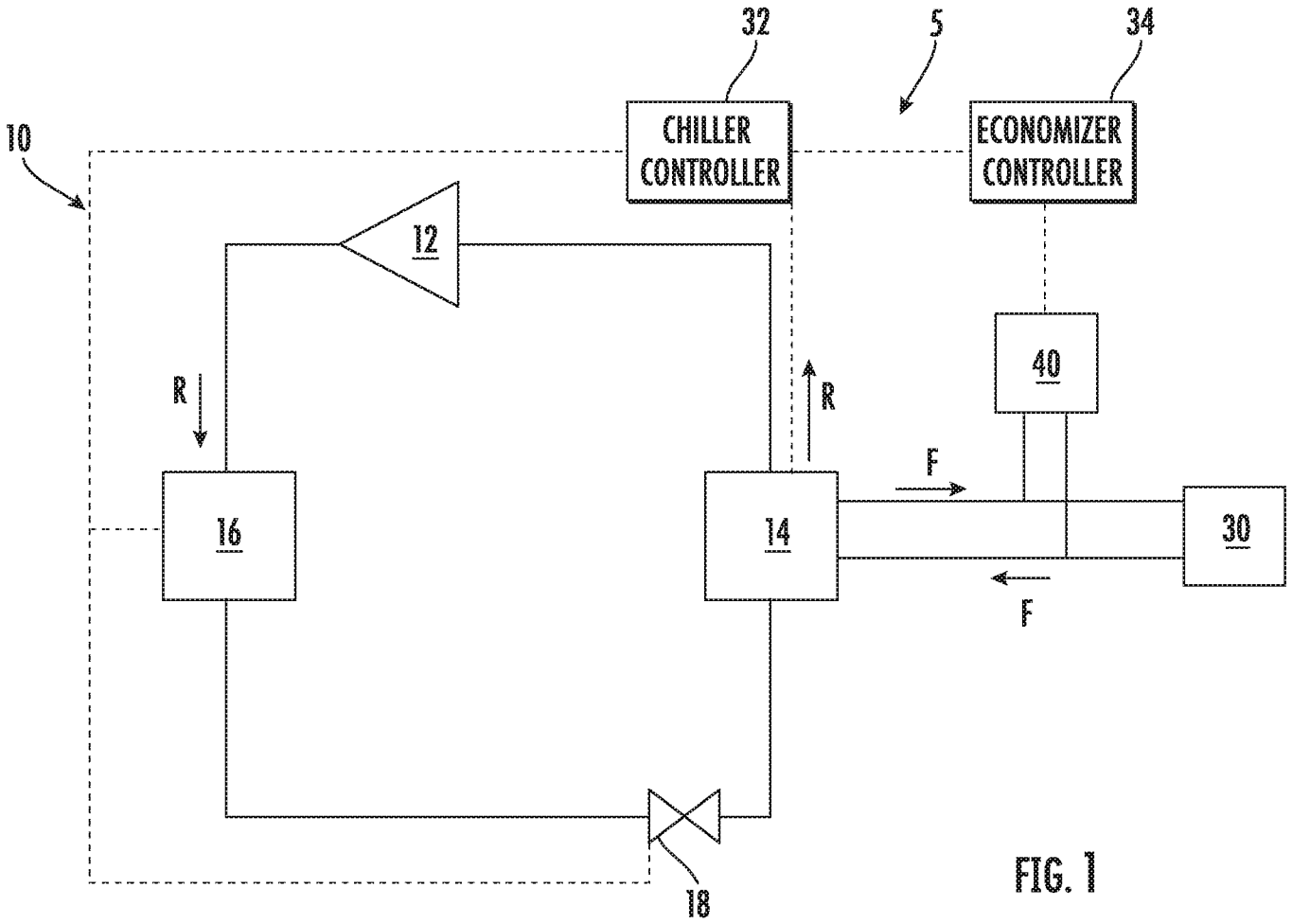
FIG. 1 is a schematic diagram of an example of a chiller refrigeration system including a waterside economizer.

FIG. 1 illustrates a schematic diagram of a chiller system 5. The chiller system 5 includes a conventional vapor compression or refrigeration cycle 10. A refrigerant fluid, such as R-410A or R-134a (R) for example, is configured to circulate through the vapor compression cycle 10 such that the refrigerant R absorbs heat when evaporated at a low temperature and pressure and releases heat when condensed at a higher temperature and pressure. Within the vapor compression cycle 10, the refrigerant R flows in a counterclockwise direction as indicated by the arrows. A compressor 12 receives refrigerant vapor from an evaporator 14 and compresses the refrigerant vapor to a higher temperature and pressure. The relatively hot vapor then passes through a condenser 16 where the refrigerant is cooled and condensed to a liquid state by a heat exchange relationship with a cooling medium such as air or water. The liquid refrigerant R then passes from the condenser 16 to an expansion valve 18 where the refrigerant R is expanded to a low temperature two phase liquid/vapor state as it passes to the evaporator 14. After the addition of heat in the evaporator 14, low pressure vapor then returns to the compressor 12 where the refrigeration cycle is repeated.

The chiller system 5 additionally includes a secondary system 30, such as an air handler for example, fluidly coupled to the vapor compression cycle 10 of the chiller system 5. As shown, a fluid F, such as water or glycol for example, is provided from the secondary system 30 to the evaporator 14. Within the evaporator 14, heat is rejected from the fluid F to the refrigerant R, such that a cool fluid F is returned to the secondary system 30. Within the secondary system 30, the fluid F may be circulated to a building or conditioned space to cool and dehumidify air associated therewith.

To improve the overall efficiency of both the vapor compression cycle 10 and the secondary system 30, a hydronic or fluid economizer 40 may be connected to the fluid circuit extending between the vapor compression cycle 10 and the secondary system 30. The economizer 40 may be used in place of, or in addition to the evaporator 14, to cool the fluid F. Fluid or hydronic economizers 40 are typically located exterior to a building to allow for cooling of the fluid F using ambient air. As a result, inclusion of the fluid economizer 40 may be particularly beneficial in cooler climates where the ambient temperature is sufficient to cool the fluid F.

Furthermore, a chiller controller 32 is in electrical communication with the compressor 12, evaporator 14, condenser 16, and the expansion valve 18 to monitor the refrigerant R in the respective devices or to control operation of the respective devices. Additionally, an economizer controller 34 is in electrical communication with the economizer 40 to monitor and control operation of the economizers 40. Additionally, the economizer controller 34 can communicate with the existing chiller controller 32. Alternatively, the economizer controller 34 could be integrated into the chiller controller 32.

Figure 1A:
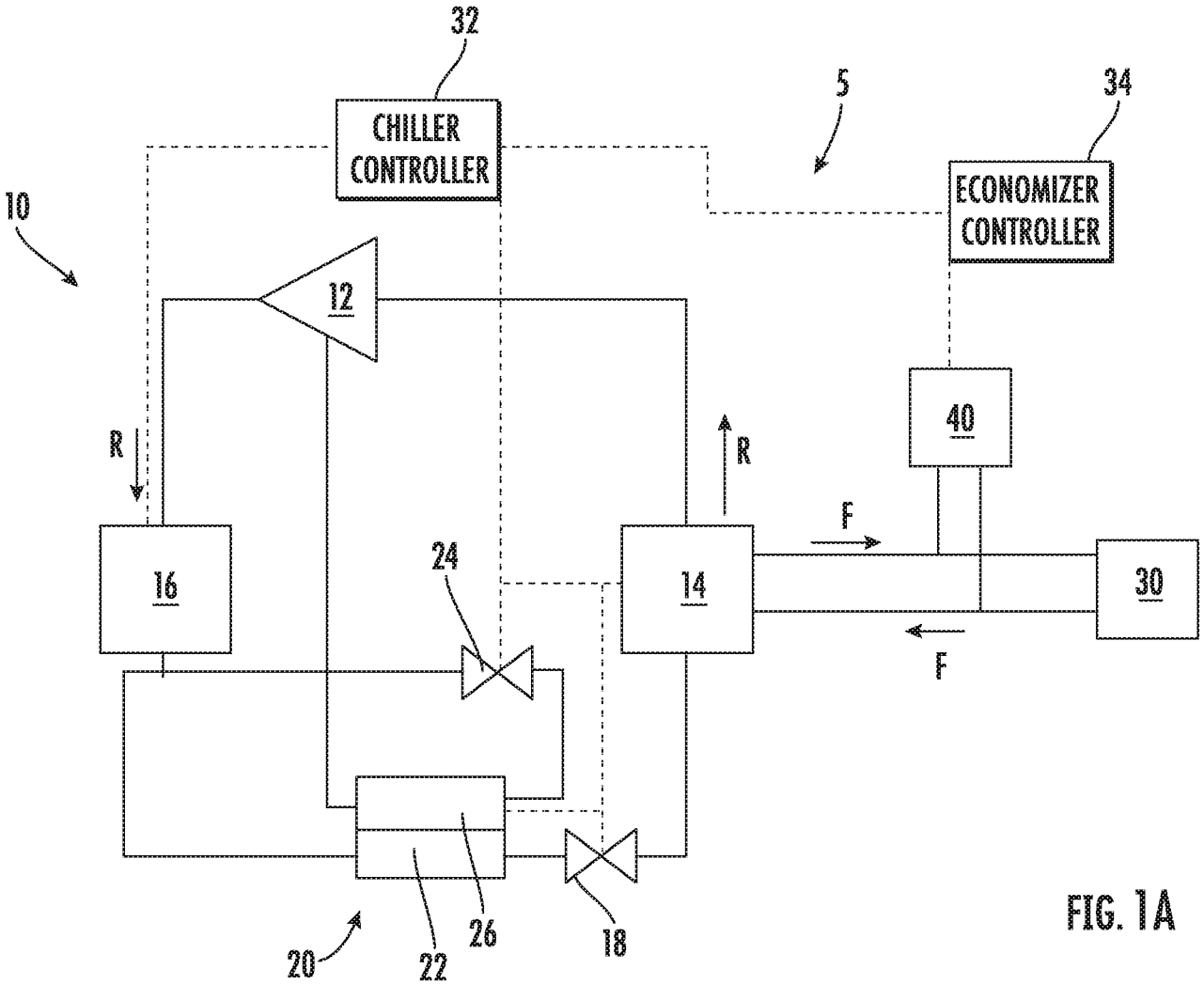
FIG. 1A is a schematic diagram of another example chiller refrigeration system including a waterside economizer and a refrigerant economizer.

FIG. 1A illustrate another example vapor compression cycle 10 similar to the vapor compression cycle 10 described in FIG. 1 except where described below or shown in the Figures. The vapor compression cycle 10 in FIG. 1A includes the addition of a refrigerant economizer heat exchanger 20 arranged downstream from the condenser 16. In the illustrated example, the refrigerant R output from the condenser 16 is split between two fluid flow paths. A first portion of the refrigerant R flows through one or more passes 22 of the economizer heat exchanger 20 before being supplied to the expansion valve 18. A second portion of the refrigerant R passes through a valve 24 before reaching one or more passes 26 of the economizer heat exchanger 20. The distinct flows of refrigerant R are arranged in a heat exchange relationship within the economizer heat exchanger 20.

By cooling the refrigerant R in the second flow path, inclusion of the economizer heat exchanger 20 further cools the refrigerant R provided to the expansion valve 18. The refrigerant in the second flow path absorbs heat from the first refrigerant flow path and becomes a vapor. This vapor is then provided directly to an intermediate portion of the compressor 12, thereby bypassing the expansion valve 18 and evaporator 14 of the vapor compression cycle 10. Inclusion of the economizer heat exchanger 20 increases the overall efficiency of the vapor compression cycle 10. However, it should be understood that vapor compression systems that do not include an economizer heat exchanger 20 or have another configuration are also contemplated herein.

Figure 1B:
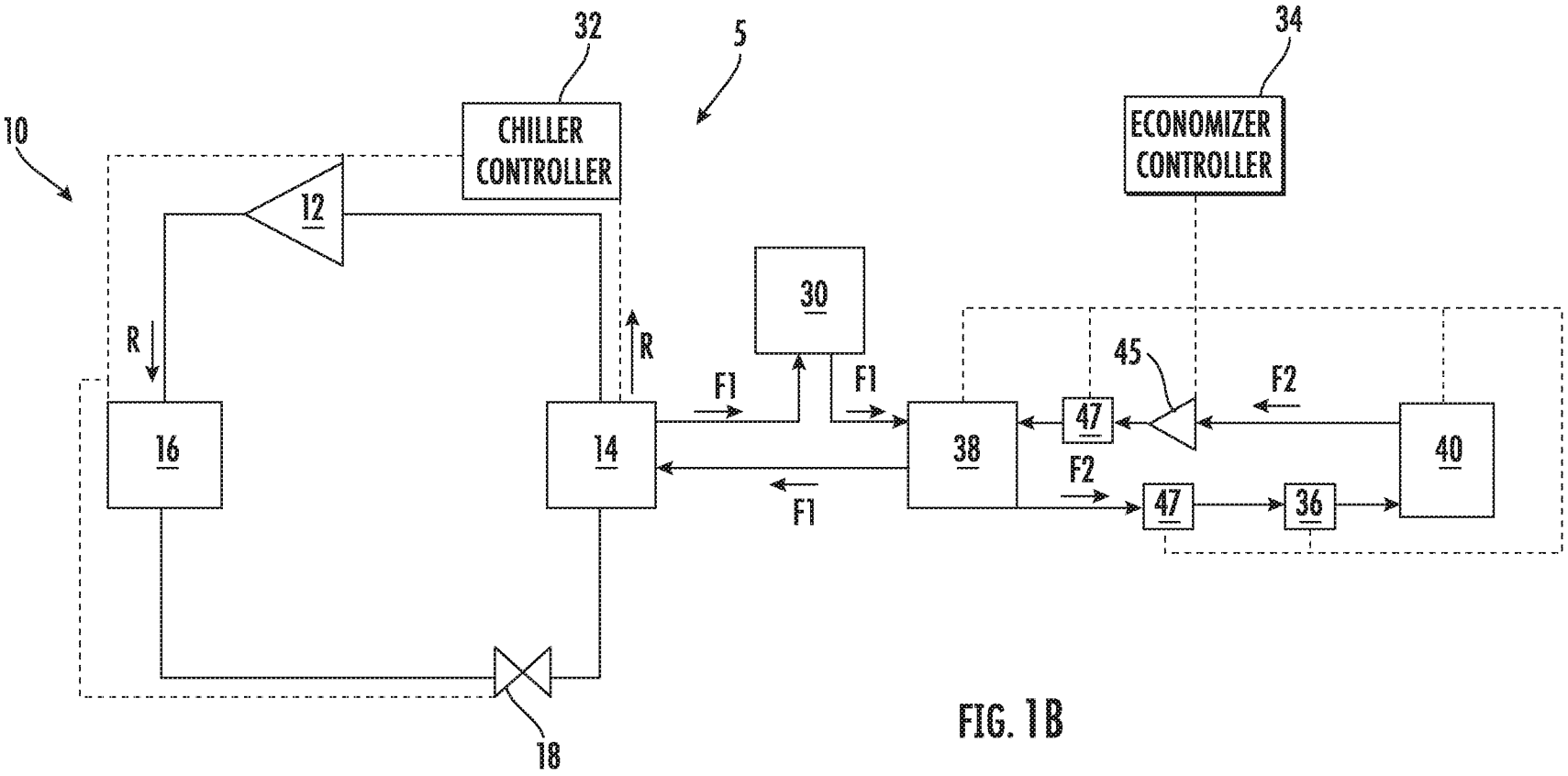
FIG. 1B is a schematic diagram of yet another example chiller refrigeration system including a waterside economizer and a heat exchanger.

FIG. 1B illustrates another example chiller system 5 similar to the chiller system 5 described in FIG. 1 except where described below or shown in the Figures. In the illustrated example, a circulation pump 45, an expansion tank 36, and at least one isolation valve 47 are associated with the economizer 40 to circulate a flow of fluid F2 through the economizer 40 and a brazed plate heat exchanger 38. The brazed plate heat exchanger 38 transfers heat from a fluid F1 being circulated through the evaporator 14 and the secondary system 30 into the fluid F2 associated with the economizer 40. As shown in FIG. 1B, the economizer controller 34 controls and or monitors the circulation pump 45, the expansion tank 36, the at least one isolation valve 47, and the economizer 40.

Figure 2:
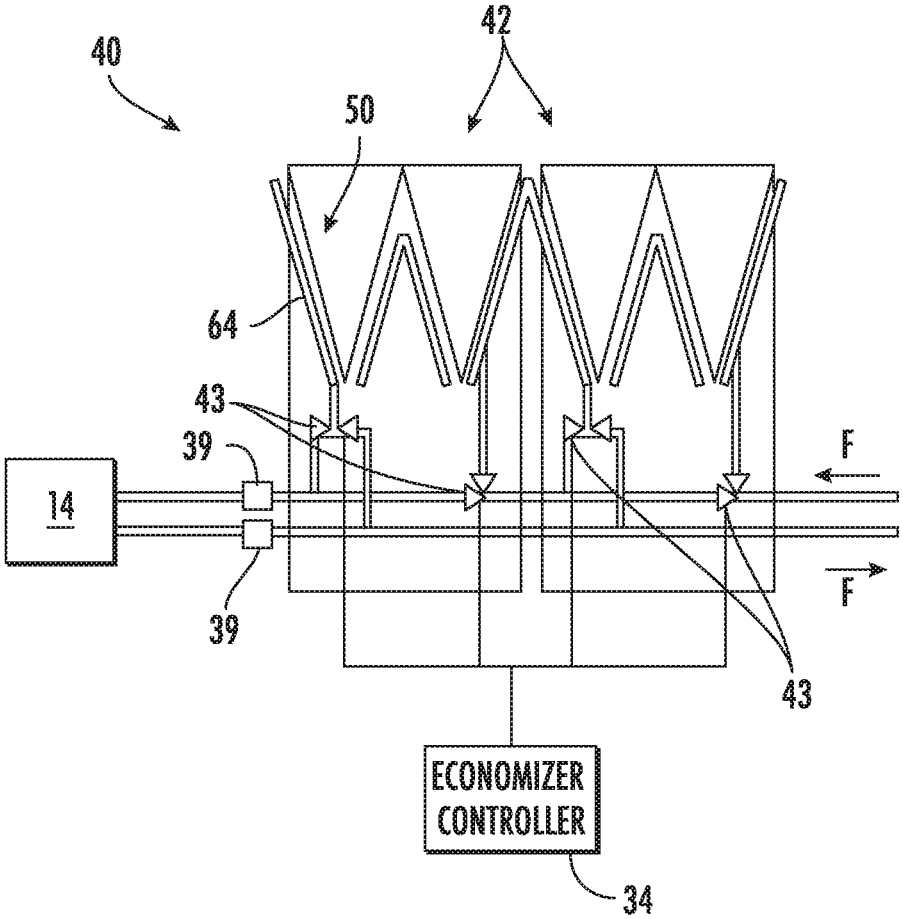
FIG. 2 is a schematic diagram of an example waterside economizer.

Referring now to FIG. 2, an example of the fluid economizer 40 used in conjunction with the vapor compression cycle 10 and the secondary system 30 in FIGS. 1-1B is illustrated in more detail. The fluid economizer 40 can be connected with the evaporator 14 through water valves connections 39 to allow the fluid economizer 40 to be retrofitted with an existing chiller system 5. The fluid economizer 40 includes one or more economizer modules 42 arranged generally adjacent one another, such as in stacked alignment for example. In examples where the fluid economizer 40 includes a plurality of modules 42, the modules 42 may have a similar configuration, or alternatively, may have distinct configurations. Any number of economizer modules 42 may be included such that the heat exchange capacity of the plurality of modules 42 is sufficient to meet the cooling requirements for a given application. Each economizer module 42 is arranged in fluid communication with an inlet conduit and includes a valve 43, such as a three way valve for example, to selectively control a flow of fluid F to the module 42. The valves 43 are operable such that the modules 42 may be arranged in series or in parallel with the evaporator 14. In examples where the fluid economizer 40 includes a plurality of modules 42, the fluid F is configured to flow through the plurality of modules 42 in parallel. Alternatively, the fluid F may be configured to flow through all or at least a portion of the plurality of modules 42 in series.

Figure 3A:
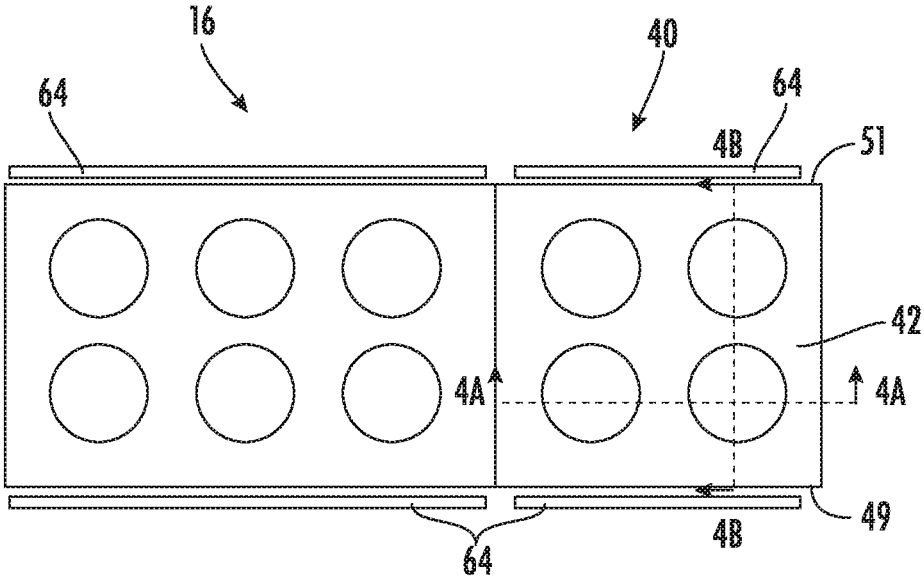
FIG. 3A is a top view of an example waterside economizer and condenser of the chiller refrigeration system.
Figure 3B:
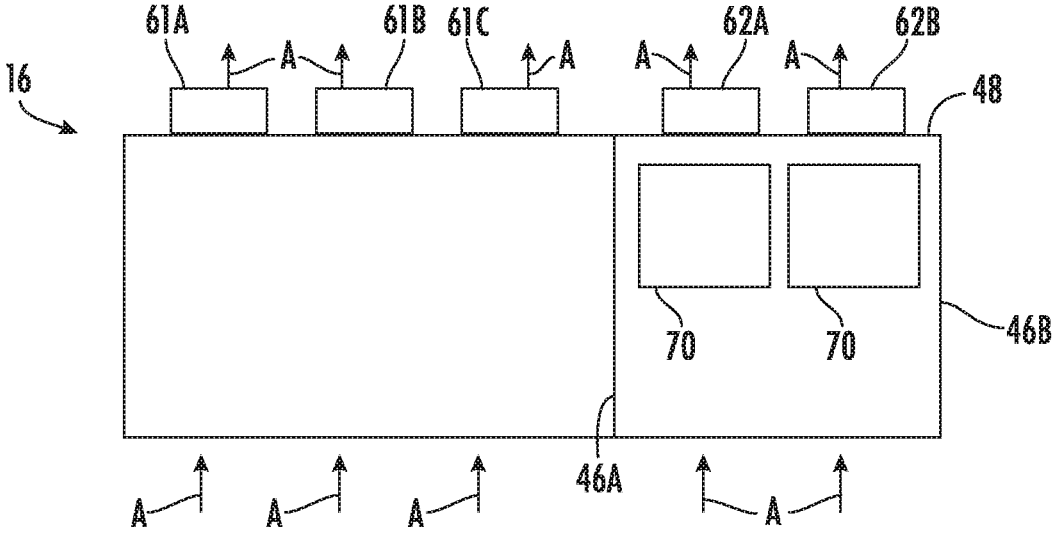
FIG. 3B is a front view of the example waterside economizer and condenser of FIG. 3A.

With reference to FIGS. 3A and 3B, in an example, the one or more modules 42 of the fluid economizer 40 may be generally aligned with the one or more coils of the condenser unit 16 of the vapor compression cycle 10. Because the fluid economizer 40 is arranged in parallel with the condenser 16, relative to the airflow identified by arrows A, inclusion of the economizer modules 42 does not increase the airside pressure drop, resulting in a higher efficiency. In particular, the condenser 16 includes fans 61A, 61B, 61C that draw air through the condenser 16 and the fluid economizer 40 includes fans 62A, 62B that draw air through the fluid economizer 40. The fluid economizer 40 may also include access panels 70, such as doors, to provide access to each of the economizer modules 42 for cleaning or servicing. The condenser 16 and fluid economizer 40 may be removably attached to each other to allow for the condenser 16 and the fluid economizer 40 to be shipped together or separately.

Figure 4A:
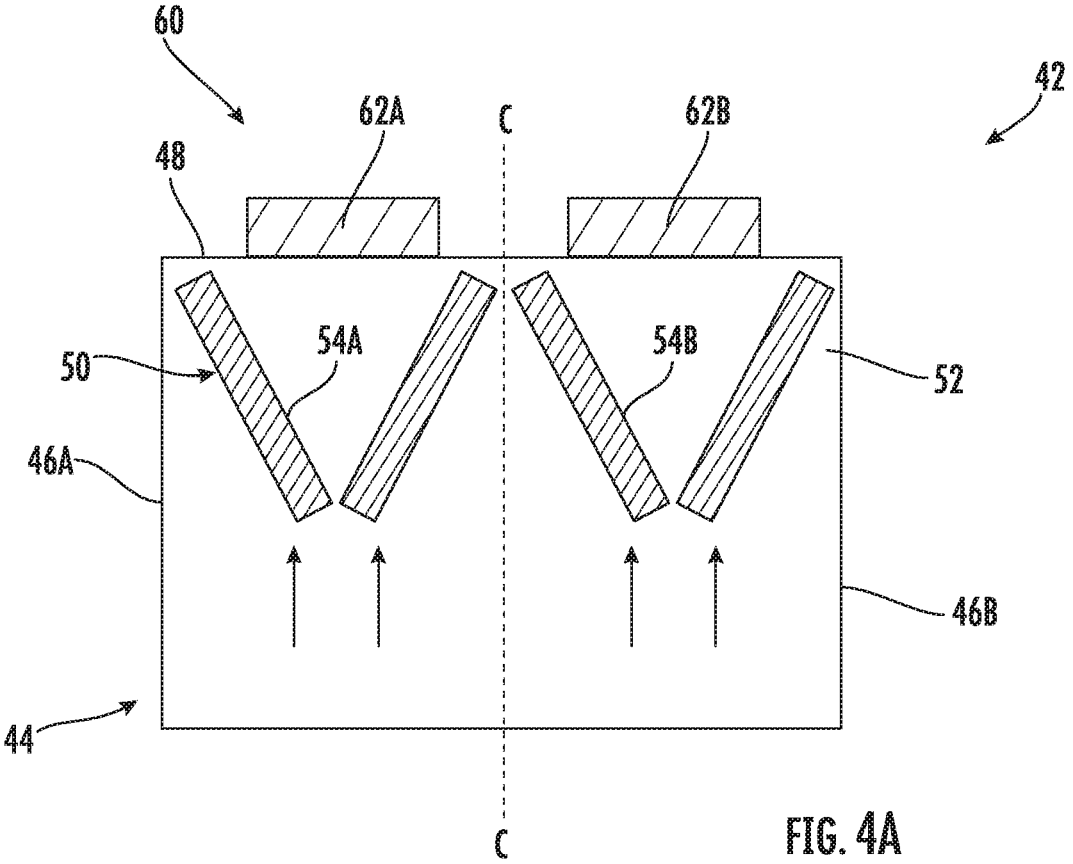
FIG. 4A is a cross-sectional view along line 4A-4A of FIG. 3A illustrating an example water economizer module of the economizer with a "V" configuration.

With reference now to FIG. 4A, an example of a hydronic fluid economizer module 42 is illustrated in more detail. Each economizer module 42 includes a housing or cabinet 44. One or more sides 46A, 46B of the housing 44 define an inlet for air to flow into the economizer module 42. Similarly, an end 48 of the housing 44 defines an outlet opening for air to exit from the economizer module 42. Located within the housing 44 of each economizer module 42 is a heat exchanger assembly 50 arranged between the opposing longitudinal sides 46A, 46B.

The cross-section of the heat exchanger assembly 50 is generally constant over a length of the economizer module 42, such as between a front surface 52 and a back surface (not shown) for example. The heat exchanger assembly 50 includes at least one heat exchanger coil 54A, 54B, that may include a round tube plate fin heat exchanger coil or a ported flat tube heat exchanger coil formed having copper coils and aluminum fins. In examples where the heat exchanger assembly 50 includes a plurality of heat exchanger coils 54A, 54B, the heat exchanger coils 54A, 54B may, but need not be, arranged generally symmetrically or equidistantly spaced from a center of the economizer module 42 between the opposing longitudinal sides 46A, 46B, as illustrated schematically by line C. The heat exchanger coils 54A, 54B can also include a corrosive resistant coating and the heat exchanger coils 54A, 54B are round or flat tubes and made from at least one of copper or aluminum.

Figure 4B:
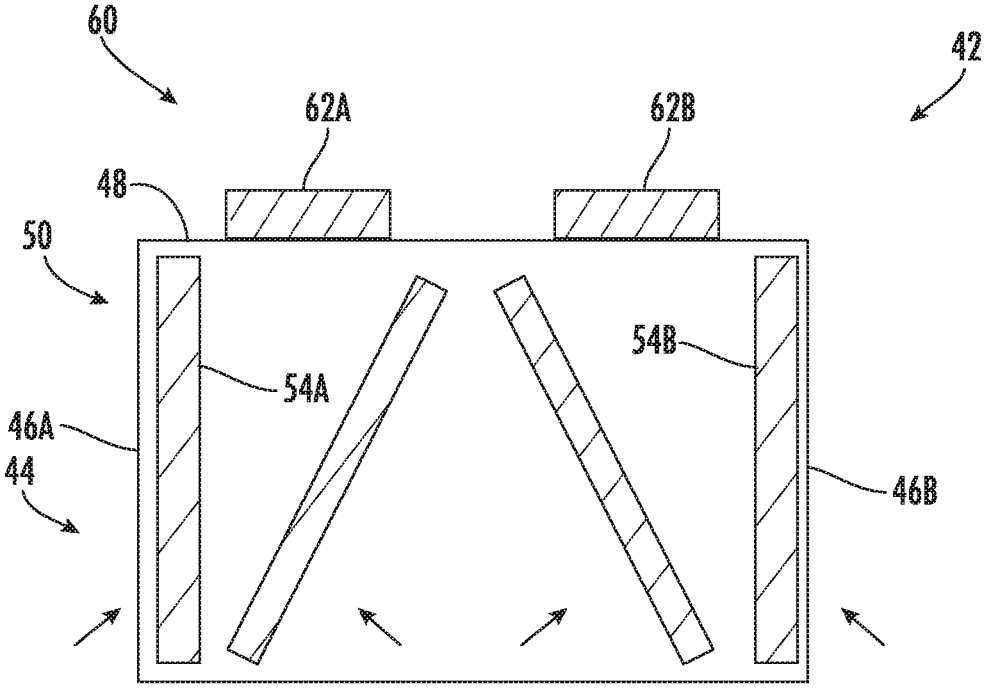
FIG. 4B is a cross-sectional view along line 4B-4B of FIG. 3A of another example water economizer module of the economizer with a "W" configuration.

In the illustrated, non-limiting example, the heat exchanger assembly 50 includes at least a first heat exchanger coil 54A mounted to the first longitudinal side 46A of the housing 44 and at least a second, heat exchanger coil 54B mounted to the second longitudinal side 46B of the housing 44. The first heat exchanger coil 54A and the second heat exchanger coil 54B may, but need not be, substantially identical. The plurality of heat exchanger coils 54A, 54B may be arranged within the housing 44 such that at least a portion of the heat exchanger assembly 50 has a generally V-shaped configuration, as is known in the art. In the illustrated, non-limiting example, the at least one first heat exchanger coil 54A includes a pair of heat exchanger coils arranged in a V-shaped configuration and the at least one second heat exchanger coil 54B includes a pair of heat exchanger coils arranged in a V-shaped configuration. However, alternative configurations of the heat exchanger assembly 50, such as the generally W-shaped configuration (FIG. 4B), an A-shaped configuration, or a generally horizontal configuration for example, are also within the scope of the disclosure. The at least one first and second heat exchanger coils can be coated with an environmental protective coating such as an epoxy based coating to prevent corrosion.

The economizer module 42 additionally includes a fan assembly 60 including one or more fans 62A, 62B configured to circulate air through the housing 44 and the heat exchanger assembly 50. The fans 62A, 62B can also be variable speed fans or single speed fans. Depending on the characteristics of the economizer module 42, the fan assembly 60 may be positioned either downstream with respect to the heat exchanger assembly 50 (i.e. "draw through configuration") as shown in the FIG. 4, or upstream with respect to the heat exchanger assembly 50 (i.e. "blow through configuration"). In the draw-through configuration, as shown, the fan assembly 60 may be mounted at the first end 48 of the housing 44. In an example, the fan assembly 60 includes a plurality of fans 62A, 62B substantially equal to the plurality of heat exchanger coils 54A, 54B in the heat exchanger assembly 50. In such examples, each fan 62A, 62B is configured to draw air through a respective heat exchanger coil 54A, 54B, and is generally vertically aligned with that coil 54A, 54B, respectively. However, examples where the fan assembly 60 includes only a single fan 62, two fans 62, or where the total number of fans 62 is different than the number of heat exchanger coils 54 are also contemplated herein. In addition, the one or more fans 62 of the fan assembly 60 may be configured as fixed speed fans, or alternatively, may have a variable speed capability.

Operation of the at least one fan 62 associated with the at least one heat exchanger coil 54 causes air to flow through an adjacent air inlet and into the housing 44 of the economizer module 42. As the air passes over the heat exchanger coil 54 (See arrows in FIGS. 4A-4B), heat transfers from the fluid F inside the heat exchanger coil 54 to the air, thereby cooling the fluid F and causing the temperature of the air to increase. The warm air is then exhausted from the from module 42, and the cooler fluid F is returned to the fluid circuit where it is either further cooled, or returned to the secondary system 30.

With reference again to FIG. 2, in an example, each economizer module 42 may additionally include a plurality of water spray nozzles 64, also referred to as evaporative pre-coolers, substantially aligned with the plurality to coils 54 of the heat exchanger assembly 50. These added water spray nozzles 64 are operable to enhance the free cooling coils 54 by allowing the air temperature within a corresponding economizer module 42 to be reduced through the evaporation of water. This evaporation of water can lower the air temperature closer to the ambient wetbulb temperature that in some dry climates can be as much as 40 F lower than the drybulb temperature. It should be understood that in an example, the condenser 16 of the vapor compression cycle 10 may additionally include water spray nozzles 64 intended to enhance the operation thereof.

In an example, the plurality of spray nozzles 64 are be formed in a grid and located directly upstream from the heat exchanger assembly 50 with respect to the flow of air through the module 42. The spray nozzles 64 are selectively operable to generate a mist adjacent the underside of the heat exchanger coils 54. The mist is configured to reduce the local ambient temperature surrounding the heat exchanger assembly 50 to a temperature close to the wet bulb temperature and facilitate evaporative cooling. Accordingly, operation of the spray nozzles 64 changes the temperature and humidity of the air passing through the coils 54 without adding condensation thereto. In an example, the spray nozzles 64 are operated only if two conditions are met. First, the wetbulb temperature must be less than the temperature of the fluid F by a predetermined amount and second, the wetbulb temperature must be less than the dry bulb temperature by a predetermined amount.

With reference again to FIG. 1, the vapor compression cycle 10 and the waterside economizer 40 may be operated in a plurality of modes to cool the fluid F. The mode of operation may be determined based on a sensed ambient temperature. In a first, normal mode of operation, the valves 43 that control the flow of fluid to the economizer modules 42 are in a closed position. As a result, fluid F flows from the secondary system 30 to the evaporator 14 of the vapor compression cycle 10 where it is mechanically cooled before being returned to the secondary system 30. The system is operated in the first mode when the ambient temperature is substantially warmer than a predetermined threshold.

In a second, free cooling mode, the valves 43 are positioned to direct the entire fluid flow F into the one or more modules 42 of the fluid economizer 40. Within the heat exchanger assemblies 50 of each module, the fluid F is arranged in a heat exchange relationship with cool ambient air. The cooled fluid F is then returned directly to the secondary system 30. Accordingly, in free-cooling mode, the evaporator 14 is not used to cool the fluid F. In such examples, the vapor compression cycle 10 need not be operational since all cooling is performed by the fluid economizer 40. In the second mode of operation, the ambient temperature is below the predetermined threshold such that the ambient air alone is capable of cooling the fluid F. In a third pre-cooling mode of operation, the fluid F is provided to the fluid economizer 40 and then to the evaporator 14 in series. In an example, the system is operated in a pre-cooling mode when the ambient temperature is too warm to fully cool the fluid F. It should be understood that the spray nozzles 64 may be used in either the second, free-cooling mode, or the third pre-cooling mode of operation.

Although the different non-limiting examples are illustrated as having specific components, the examples of this disclosure are not limited to those particular combinations. It is possible to use some of the components or features from any of the non-limiting examples in combination with features or components from any of the other non-limiting examples.

It should be understood that like reference numerals identify corresponding or similar elements throughout the several drawings. It should also be understood that although a particular component arrangement is disclosed and illustrated in these exemplary examples, other arrangements could also benefit from the teachings of this disclosure.

The foregoing description shall be interpreted as illustrative and not in any limiting sense. A worker of ordinary skill in the art would understand that certain modifications could come within the scope of this disclosure. For these reasons, the following claim should be studied to determine the true scope and content of this disclosure.

What is claimed is:

1. A chiller system comprising:

a vapor compression cycle circulating a refrigerant and including:

a condenser, the condenser including a condenser housing and at least one condenser fan configured to circulate a first flow of air through the condenser housing, and wherein the condenser is configured such that, in operation, the refrigerant is cooled by the first flow of air, and an evaporator, the evaporator configured to receive fluid from a first fluid loop, and wherein the evaporator is configured such that, in operation, heat from the fluid of the first fluid loop is rejected to the refrigerant;

an economizer receiving fluid from the first fluid loop and including an economizer module, the economizer module including:

a module housing, a heat exchanger assembly including at least one heat exchanger coil, the heat exchanger assembly located within the module housing, and at least one economizer fan configured to circulate a second flow of air through the module housing, wherein the economizer is configured such that, in operation, fluid from the first fluid loop is cooled by the second flow of air;

wherein the module housing is attached to the condenser housing such that the first flow of air through the condenser housing is generally parallel to the second flow of air through the module housing, wherein the first flow of air and the second flow of air are discrete airflows defined by the condenser housing and the module housing, respectively.

2. The chiller system of claim 1, wherein the module housing is removably attached to the condenser housing.

3. The chiller system of claim 1, comprising a secondary cooling system in fluid communication with the evaporator of the vapor compression cycle and the economizer through the first fluid loop.

4. The chiller system of claim 3, wherein the economizer includes a circulation pump and an expansion tank configured to circulate fluid through the heat exchanger assembly of the economizer module in a second fluid loop, and comprising a flat plate heat exchanger configured to transfer heat between the first fluid loop and the second fluid loop.

5. The chiller system of claim 4, wherein the economizer includes at least one isolation valve configured to prevent fluid from flowing from the heat exchanger assembly of the economizer module to the flat plate heat exchanger.

6. The chiller system of claim 3, wherein:

the economizer module includes a valve;

when the valve is in a first position, fluid in the first fluid loop flows between the evaporator and the secondary cooling system without flowing through the heat exchanger assembly of the economizer module;

when the valve is in a second position, fluid in the first fluid loop flows between the economizer module and the secondary cooling system without flowing through the evaporator; and when the valve is in a third position, fluid in the first fluid loop flows through the evaporator, the secondary cooling system, and the heat exchanger assembly of the economizer module.

7. The chiller system of claim 6, comprising a controller configured to control the at least one valve.

8. The chiller system of claim 7, wherein the controller is configured to move the at least one valve into the first position when an ambient air temperature is above a first predetermined threshold.

9. The chiller system of claim 8, wherein the controller is configured to move the at least one valve into the second position when the ambient air temperature is below a second predetermined threshold.

10. The chiller system of claim 1, wherein the economizer module includes at least one water spray nozzle.

11. The chiller system of claim 1, wherein the economizer module is a first economizer module, and wherein the economizer includes a second economizer module adjacent to the first economizer module, the second economizer module including:

a second module housing;

a second heat exchanger assembly within the second module housing;

at least one second economizer fan configured to circulate a third flow of air through the second module housing.

12. The chiller system of claim 11, wherein the third flow of air through the second economizer module is generally parallel to both the first flow of air through the condenser and the second flow of air through the first economizer module.

13. The chiller system of claim 11, wherein:

a secondary cooling system is in fluid communication with the evaporator of the vapor compression cycle and both the first and second economizer modules in the first fluid loop;

the first economizer module includes a first valve and the second economizer module includes a second valve;

when the first and second valves are in a first configuration, fluid in the fluid loop flows between the evaporator and the secondary cooling system without flowing through the heat exchanger assemblies of the first and second economizer modules;

when the first and second valves are in a second configuration, fluid in the fluid loop flows through the heat exchanger assemblies of both the first and second economizer modules and through the secondary cooling system without flowing through the evaporator; and when the first and second valves are in a third configuration, fluid in the fluid loop flows through the evaporator, the secondary cooling system, and the heat exchanger assemblies of both the first and second economizer modules.

14. An economizer module comprising:

a module housing including a first side wall, and a second side wall opposite to the first side wall;

a heat exchanger assembly including at least one heat exchanger coil, the heat exchanger assembly located within the housing;

a fan assembly including at least one fan configured to circulate a first flow of air through the housing and between the first and second side walls; and wherein one of the first or second side walls are configured to be removably attached to a housing of a component of a vapor compression cycle such that, when the component is in use, a second flow of air through the component is generally parallel to the first flow of air, wherein the first flow of air and the second flow of air are discrete airflows defined by the housing of the component and the module housing, respectively.

15. The economizer module of claim 14, comprising at least one three way valve, and wherein the component of the vapor compression cycle is a condenser.

16. The economizer module of claim 15, comprising:

at least one water spray nozzle; and a controller, wherein the controller is configured to control the at least one three way valve and the at least one water spray nozzle based on ambient conditions.

17. The economizer module of claim 14, wherein:

the heat exchanger assembly includes a plurality of heat exchanger coils and the fan assembly includes a plurality of fans, each of the plurality of fans aligned with a respective one of the plurality of heat exchanger coils; and the economizer module includes an access panel aligned with at least one of the heat exchanger coils.

* * * * *